US005574432A

United States Patent [19]

McCarthy

[11] Patent Number: 5,574,432

[45] Date of Patent: Nov. 12, 1996

[54] APPARATUS ATTACHABLE TO A SHOE FOR DEPLOYING A RESCUE SIGNAL

[76] Inventor: Steven R. McCarthy, 7 Warren St., Maynard, Mass. 01754

[21] Appl. No.: 582,955

[22] Filed: Jan. 4, 1996

[51] Int. Cl.[6] ..... G08B 21/00

[52] U.S. Cl. ..... 340/573; 340/574; 340/690

[58] Field of Search ..... 340/573, 574, 340/690

[56] References Cited

U.S. PATENT DOCUMENTS

| | | | |
|---|---|---|---|
| 3,929,335 | 12/1975 | Malick | 340/573 |
| 4,245,218 | 1/1981 | Berkebile et al. | 340/574 |
| 4,331,953 | 5/1982 | Blevins et al. | 340/573 |

*Primary Examiner*—Glen Swann

[57] ABSTRACT

An apparatus attachable to a shoe for deploying a rescue signal includes a base attachable to a rear section of a conventional shoe. The base comprises strips coupled to a lower extent thereof and extended horizontally therefrom. The strips each have a plurality of buttons coupled thereto. The base also comprises a slot formed on an top surface thereof. Also included is a restraining unit adapted to secure about an upper extent of the shoe. The restraining unit comprises an annular band adapted to slidably insert within the slot of the base. The restraining unit further includes a pair of generally triangular members attached to the band and extended downwardly therefrom. The triangular members each have a plurality of buttonholes coupleable to the buttons disposed on the strips of the base. A metal rod is adapted to insert within a lateral bore formed in a heel of the shoe and further within a pair of apertures formed in the strips. Finally, a signalling mechanism situated within the base deploys a rescue signal upon the manual activation thereof or upon the failure to respond to an alarm adapted to indicate the cessation of a predetermined amount of time.

3 Claims, 3 Drawing Sheets

APPARATUS ATTACHABLE TO A SHOE FOR DEPLOYING A RESCUE SIGNAL

BACKGROUND OF THE INVENTION

1. Field of the Invention

The present invention relates to an apparatus for deploying a rescue signal and more particularly pertains to affording a specially designed housing structure attachable to a shoe for locating a wearer.

2. Description of the Prior Art

The use of locating devices is known in the prior art. More specifically, locating devices heretofore devised and utilized for the purpose of identifying the location of missing items are known to consist basically of familiar, expected and obvious structural configurations, notwithstanding the myriad of designs encompassed by the crowded prior art which have been developed for the fulfillment of countless objectives and requirements.

In this respect, the apparatus attachable to a shoe for deploying a rescue signal according to the present invention substantially departs from the conventional concepts and designs of the prior art, and in so doing provides an apparatus primarily developed for the purpose of affording a specially designed housing structure attachable to a shoe for locating a wearer.

Therefore, it can be appreciated that there exists a continuing need for a new and improved apparatus for deploying a rescue signal which can be used for affording a specially designed housing structure attachable to a shoe for locating a wearer. In this regard, the present invention substantially fulfills this need.

SUMMARY OF THE INVENTION

In view of the foregoing disadvantages inherent in the known types of locating devices now present in the prior art, the present invention provides an improved apparatus attachable to a shoe for deploying a rescue signal. As such, the general purpose of the present invention, which will be described subsequently in greater detail, is to provide a new and improved apparatus attachable to a shoe for deploying a rescue signal apparatus and method which has all the advantages of the prior art and none of the disadvantages.

To attain this, the present invention essentially comprises a base with a generally rectangular configuration having an arcuate outboard surface, arcuate inboard surface, top surface, bottom surface, and pair of side edges defining an interior space. The inboard surface has an opening formed therein with a removable arcuate cover for allowing selective access to the interior space. The base further comprises a pair of generally rectangular strips coupled to a lower extent of the side edges and extended horizontally therefrom. The strips each have a plurality of linearly aligned buttons coupled thereto. A tab is formed at a central extent of each of the strips and extended downwardly therefrom. A pair of axially aligned apertures are each formed in each tab. The base also comprises a lip extending upwardly from the top surface and coinciding with the outboard surface thereof. The lip has a plurality of horizontal members coupled thereto. The horizontal members each extend in an inboard radial direction and have a plurality of flanges coupled to an inboard end thereof. The flanges each extend downwardly in a skewed outboard direction thereby defining a slot. The inboard surface of the base is adapted to abut a rear extent of a shoe with the strips extending along each side extent thereof. Also included is a restraining unit comprising an annular band. The band has a top periphery and a bottom periphery with the top periphery having a smaller circumference than the same of the bottom periphery. The annular band is thus adapted to slidably insert within the slot of the base. The annular band also has a pair of clips attached to a front extent thereof for allowing the coupling and decoupling thereof. The annular band further comprises a pair of generally triangular members attached at a tip end thereof to the front extent of the band and extended downwardly therefrom. The triangular members each have a plurality of linearly aligned buttonholes releasably coupleable to the buttons disposed on the strips of the base. The restraining unit is thus adapted to secure about a portion of the shoe corresponding to an ankle of a user and further bind the base to the shoe. A metal rod with a threaded end and a bolt end is also included for affording further securement of the base to the shoe. The metal rod is adapted to insert within a lateral bore formed in a heel of the shoe and further within the apertures of the tabs located on the strips. The rod includes a nut for coupling with the threaded end of the rod. Upon the tightening of the nut, the base may be firmly fastened to the shoe. Finally, a signalling mechanism is disposed within the interior space for providing a signal upon the manual activation thereof. The signalling mechanism also deploys a signal upon the failure to respond to an alarm indication adapted to indicate an end of a predetermined amount of time. The signalling mechanism further comprises a display mechanism for depicting a time remaining in the predetermine amount of time.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus attachable to a shoe for deploying a rescue signal which has all the advantages of the prior art locating devices and none of the disadvantages.

It is another object of the present invention to provide a new and improved apparatus attachable to a shoe for deploying a rescue signal which may be easily and efficiently manufactured and marketed.

It is a further object of the present invention to provide a new and improved apparatus attachable to a shoe for deploying a rescue signal which is of a durable and reliable construction.

An even further object of the present invention is to provide a new and improved apparatus attachable to a shoe for deploying a rescue signal which is susceptible of a low cost of manufacture with regard to both materials and labor, and which accordingly is then susceptible of low prices of sale to the consuming public, thereby making such apparatus attachable to a shoe for deploying a rescue signal economically available to the buying public.

Still yet another object of the present invention is to provide a new and improved apparatus attachable to a shoe for deploying a rescue signal which provides in the apparatuses and methods of the prior art some of the advantages thereof, while simultaneously overcoming some of the disadvantages normally associated therewith.

Still another object of the present invention is to afford a specially designed housing structure attachable to a shoe for locating a wearer.

Lastly, it is an object of the present invention to provide a new and improved apparatus attachable to a shoe for deploying a rescue signal including a base attachable to a rear section of a conventional shoe. The base comprises strips coupled to a lower extent thereof and extended horizontally therefrom. The strips each have a plurality of buttons coupled thereto. The base also comprises a slot formed on an top surface thereof. Also included is a restraining unit adapted to secure about an upper extent of the shoe. The restraining unit comprises an annular band adapted to slidably insert within the slot of the base. The restraining unit further includes a pair of generally triangular members attached to the band and extended downwardly therefrom. The triangular members each have a plurality of buttonholes coupleable to the buttons disposed on the strips of the base. A metal rod is adapted to insert within a lateral bore formed in a heel of the shoe and further within a pair of apertures formed in the strips. Finally, a signalling mechanism situated within the base deploys a rescue signal upon the manual activation thereof or upon the failure to respond to an alarm adapted to indicate the cessation of a predetermined amount of time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
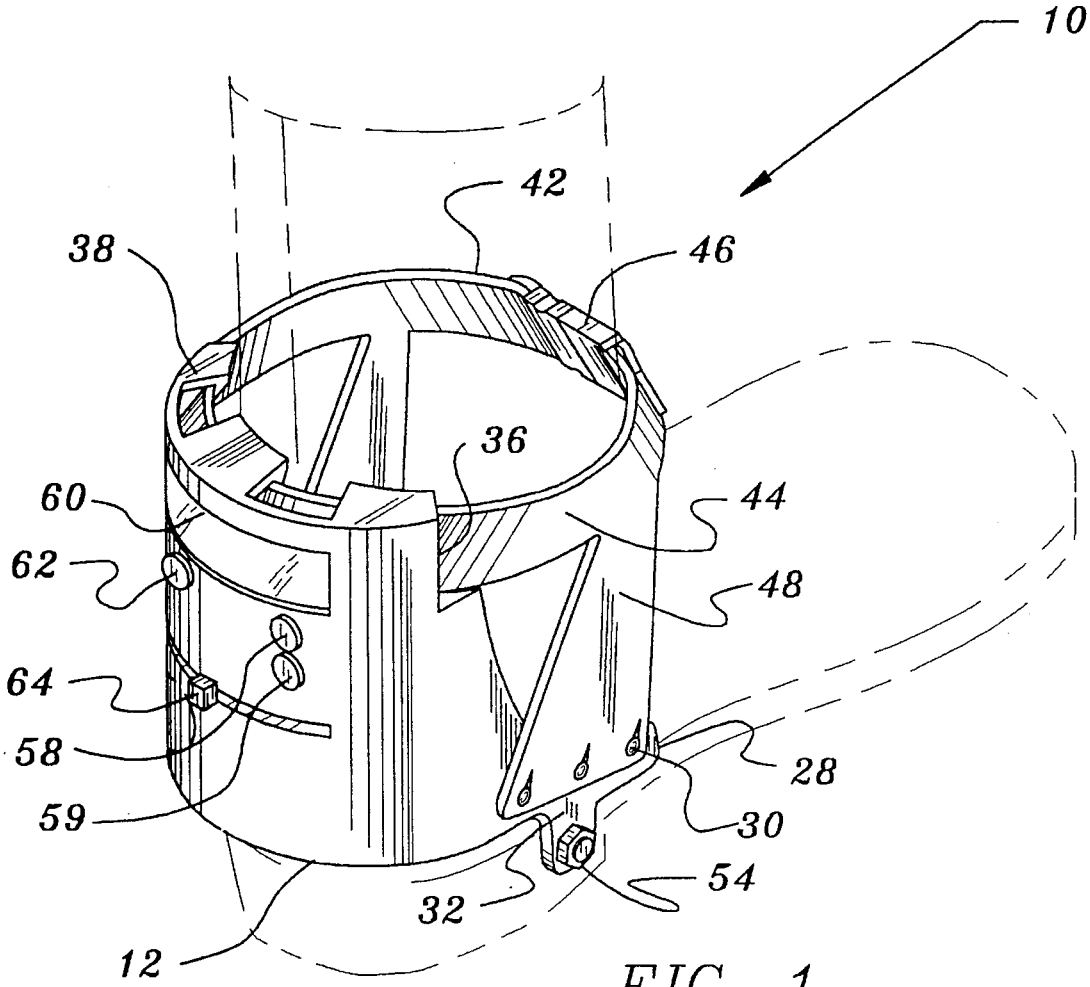
FIG. 1 is a perspective illustration of the preferred embodiment of the apparatus attachable to a shoe for deploying a rescue signal constructed in accordance with the principles of the present invention.
Figure 2:
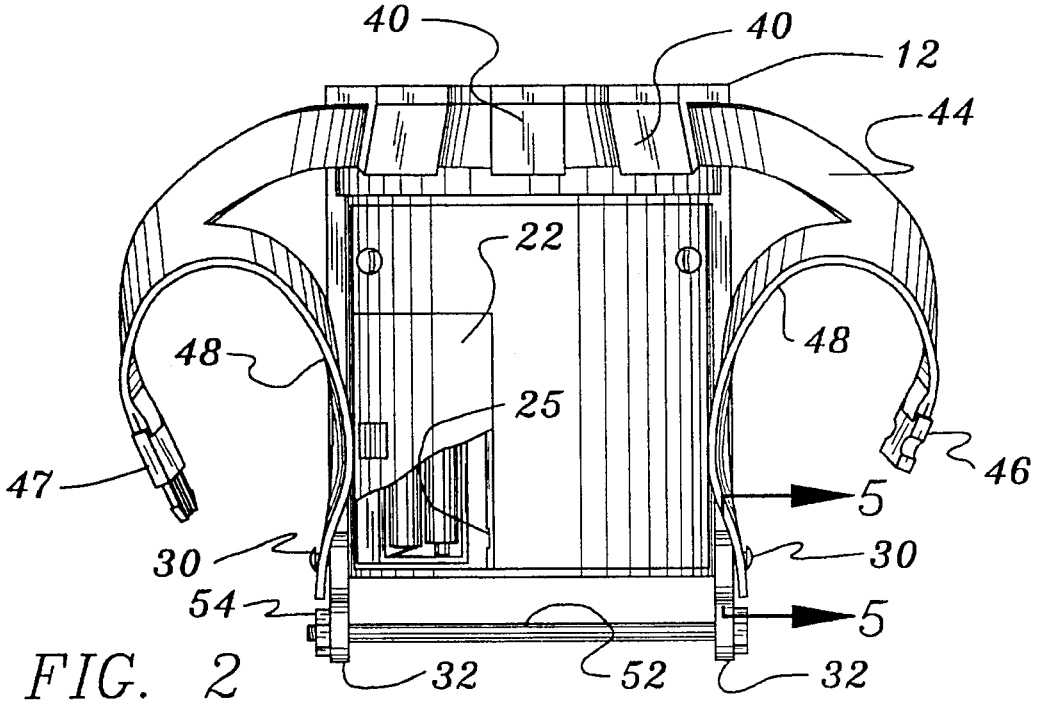
FIG. 2 is a plan view of the inboard surface of the base.
Figure 3:
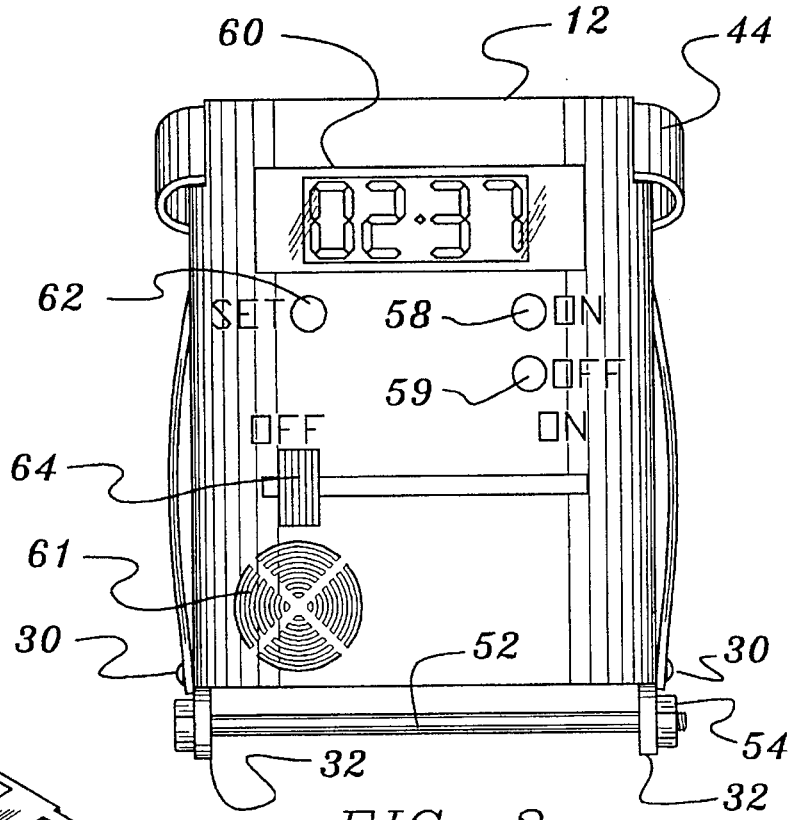
FIG. 3 is a plan view of the outboard surface of the base.

With reference now to the drawings, and in particular to FIG. 1 thereof, a new and improved apparatus attachable to a shoe for deploying a rescue signal embodying the principles and concepts of the present invention and generally designated by the reference numeral 10 will be described.

The present invention, the new and improved apparatus attachable to a shoe for deploying a rescue signal, is comprised of a plurality of components. Such components in their broadest context include a base, restraining unit, metal rod, and signalling mechanism. Such components are individually configured and correlated with respect to each other so as to attain the desired objective.

More specifically, it will be noted that the system 10 of the present invention includes a base 12 with a generally rectangular configuration having an arcuate outboard surface, arcuate inboard surface, top surface, bottom surface, and pair of side edges defining an interior space. The inboard surface has an opening 14 formed therein with a removable arcuate cover 16 for allowing selective access to the interior space. The cover comprises a first section 18 coupled to the base with coupling screws 20 and a second section 22 coupled thereto with a pair of flanges 24, associated detents 25, and a clip 26. The second section is constructed in order to allow ease of access to a compartment within the interior space allocated for battery storage. The base is ideally constructed of a resilient plastic capable of withstanding high impact, extreme temperature, and moisture.

The base further comprises a pair of generally rectangular strips 28 coupled to a lower extent of the side edges and extended horizontally therefrom. The strips each have a plurality of linearly aligned buttons 30 coupled thereto. A tab 32 is formed at a central extent of each of the strips and extended downwardly therefrom. A pair of axially aligned apertures 34 are each formed in each tab. The base also comprises a lip 36 extending upwardly from the top surface and coinciding with the outboard surface thereof. The lip has a plurality of horizontal members 38 coupled thereto. Each horizontal member extends in an inboard radial direction and has a plurality of flanges 40 coupled to an inboard end thereof. The flanges each extend downwardly in a skewed outboard direction thereby defining a slot. The flanges form an approximate 45 degree angle with respect to the horizontal. The inboard surface of the base is adapted to abut a rear extent of a shoe above the sole thereof. The strips extend along each side extent of the shoe also above the sole thereof.

Figure 4:
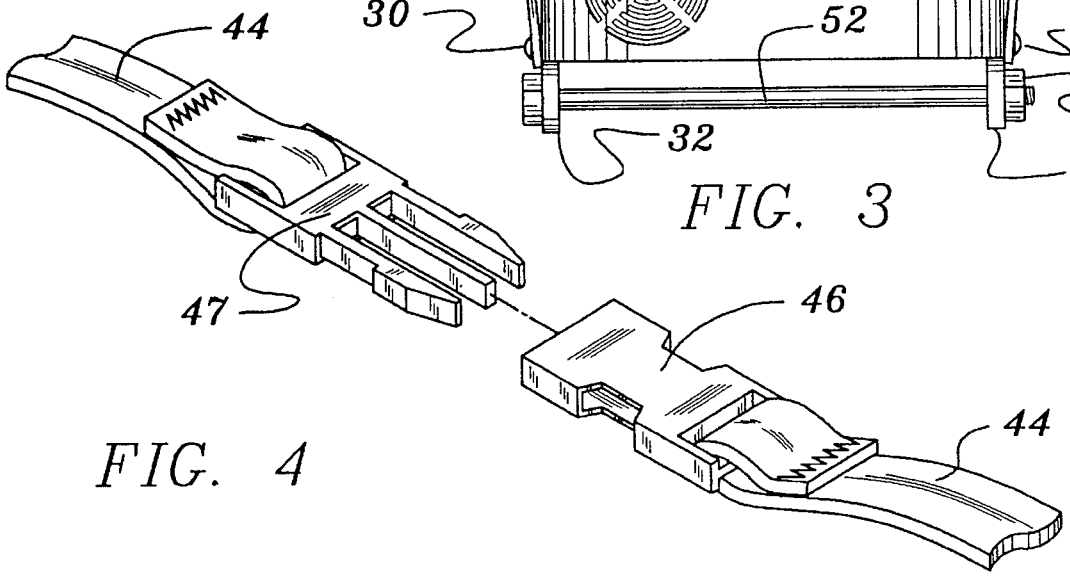
FIG. 4 is a perspective illustration of the clips of the restraining unit.
Figure 5:
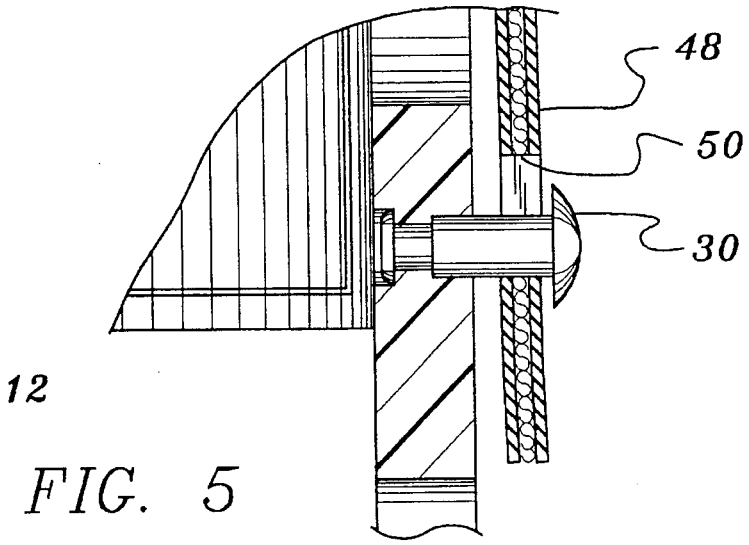
FIG. 5 is a close-up view of the coupling between the strip of the base and the triangular member of the restraining unit.
Figure 6:
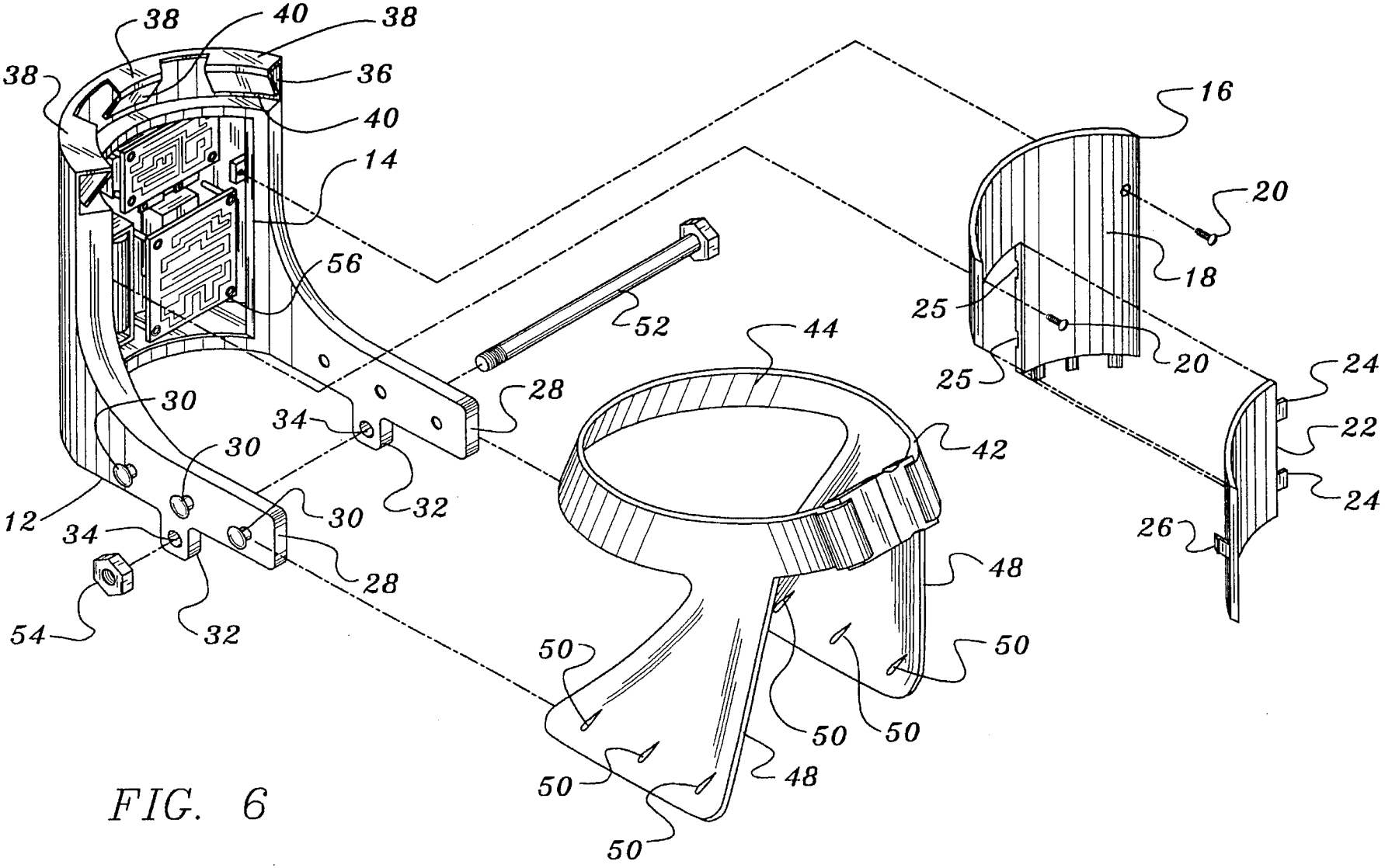
FIG. 6 is a perspective illustration of the present invention in a disassembled orientation.

Also included is a restraining unit 42 comprising an annular band 44. The band has a top periphery and a bottom periphery with the top periphery having a smaller circumference than the same of the bottom periphery. Such a construction situates the band at an approximate 45 degree angle with respect to the horizontal. The annular band is thus adapted to slidably insert within the slot of the base. The annular band also has a pair of clips including a female clip 46 and a male clip 47 both attached to a front extent thereof for allowing the coupling and decoupling thereof. Such clips are preferably constructed similar to those shown in FIG. 4 so as to avoid failure if exposed to dirt or water. The restraining unit further comprises a pair of generally triangular members 48 attached at a tip end thereof to the front extent of the band and extended downwardly therefrom. The triangular members each have a plurality of linearly aligned buttonholes 50 releasably coupleable to the buttons disposed on the strips of the base. The buttons may be selectively coupled to the buttonholes in order to accommodate various sizes of shoes. The annular band is thus adapted to secure about a portion of the shoe corresponding to an ankle of a user and further bind the base to the shoe.

A metal rod 52 with a threaded end and bolt end is also included for affording further securement of the base to the shoe. The metal rod is adapted to insert within a lateral bore formed in a heel of the shoe and further within the apertures of the tabs located on the strips. The rod and associated strips thus afford a clevis-type couple especially designed to attach the present invention to the heel of a shoe. The rod includes a nut 54 for coupling with the threaded end of the rod. Upon the tightening of the nut, the base may be firmly fastened to the shoe.

Finally, a signalling mechanism 56 is disposed within the interior space for providing a signal upon the manual activation thereof. Such mechanism comprises of circuitry with an associated activation button 58 and deactivation button 59 disposed on the outboard surface of the base. The activation button allows the actuation of the signalling mechanism upon the depression thereof. The circuitry is also adapted to deploy a signal upon the failure to respond to an audio alarm 61 which sounds on the cessation of a predetermined amount of time. Such audio alarm ideally comprises of a low-power beeper and is adapted to indicate an end of the predetermined amount of time. The signalling mechanism further comprises a display mechanism 60 for depicting a time remaining in the predetermined amount of time thus resembling a timer. The display mechanism preferably comprises a liquid crystal display. The signalling mechanism further comprises a set button 62 and a manual sliding lever 64 for selectably determining the length of the predetermined amount of time. Finally, the response required to restart the timer consists of depressing the activation button.

The present invention offers a method of locating a person lost or injured in remote areas. Such a device would be ideal for skiers, campers, rescue officials, forest rangers, and the like. The apparatus may be retrofitted to any existing shoe or integrally manufactured therewith.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus attachable to a shoe for deploying a rescue signal comprising, in combination:

a base with a generally rectangular configuration having an arcuate outboard surface, an arcuate inboard surface, a top surface, a bottom surface, and a pair of side edges defining an interior space, the inboard surface having an opening formed therein with a removable arcuate cover for allowing selective access to the interior space, the base further comprising a pair of generally rectangular strips coupled to a lower extent of the side edges and extended horizontally therefrom, the strips each having a plurality of linearly aligned buttons coupled thereto and a tab formed at a central extent thereof and extended downward therefrom with each tab having an axially aligned aperture formed therein, the base also comprising a lip extending upwardly from the top surface and coinciding with the outboard surface thereof, the lip having a plurality of horizontal members coupled thereto and extending in an inboard radial direction and a plurality of flanges coupled to an inboard end of each horizontal member and extending downwardly in a skewed outboard direction thereby defining a slot, whereby the inboard surface of the base is adapted to abut a rear extent of a shoe with the strips extending along each side extent thereof;

a restraining unit comprising an annular band having a top periphery and a bottom periphery with the top periphery having a smaller circumference than the bottom periphery whereby the annular band is adapted to be slidably inserted within the slot of the base, the annular band having a pair of clips attached to a front extent thereof for allowing the coupling and decoupling thereof, the annular band further comprising a pair of generally triangular members attached at a tip end thereof to the front extent of the band and extended downwardly therefrom with a plurality of linearly aligned buttonholes releasably coupleable to the buttons disposed on the strips of the base, whereby the restraining unit is adapted to secure about a portion of the shoe corresponding to an ankle of a user and further bind the base to the shoe;

a metal rod with a threaded end and a bolt end adapted to insert within a lateral bore formed in a heel of the shoe and further within the apertures of the tabs located on the strips, the rod further comprising a nut for coupling with the threaded end of the rod and firmly fastening the base to the shoe; and signalling means disposed within the interior space for providing a signal upon the manual activation thereof and further for providing a signal upon the failure to respond to an alarm adapted to indicate an end of a predetermined amount of time, the signalling means further comprising display means for depicting a time remaining in the predetermine amount of time.

2. A rescue apparatus comprising signalling means for providing a signal upon the manual activation thereof and further for providing a signal upon the failure to respond to an alarm indication means adapted to indicate a cessation of a predetermined amount of time, wherein the signalling means further comprises display means for depicting a time remaining in the predetermined amount of time.

3. A rescue apparatus comprising signalling means for providing a signal upon the manual activation thereof and further for providing a signal upon the failure to respond to an alarm indication means adapted to indicate a cessation of a predetermined amount of time;

a housing adapted to attach to a conventional shoe and further contain the signalling means and alarm indication means, wherein the housing comprises a base with a generally rectangular configuration having an arcuate outboard surface, an arcuate inboard surface, a top surface, a bottom surface, and a pair of side edges defining an interior space for containing the signalling means and alarm indication means, the inboard surface having an opening formed therein with a removable arcuate cover for allowing selective access to the interior space, the base further comprising a pair of generally rectangular strips coupled to a lower extent of the side edges and extended horizontally therefrom, the strips each having a plurality of linearly aligned buttons coupled thereto and a tab formed at a central extent thereof and extended downward therefrom with each tab having an axially aligned aperture formed therein, the base also comprising a lip extending upwardly from the top surface and coinciding with the outboard surface thereof, the lip having a plurality of horizontal members coupled thereto and extending in an inboard radial direction and a plurality of flanges coupled to an inboard end of each horizontal member and extending downwardly in a skewed outboard direction thereby defining a slot, whereby the inboard surface of the base is adapted to abut a rear extent of a shoe with the strips extending along each side extent thereof;

a restraining unit comprising an annular band having a top periphery and a bottom periphery with the top periphery having a smaller circumference than the bottom periphery whereby the annular band is adapted to be slidably inserted within the slot of the base, the annular band having a pair of clips attached to a front extent thereof for allowing the coupling and decoupling thereof, the annular band further comprising a pair of generally triangular members attached at a tip end thereof to the front extent of the band and extended downwardly therefrom with a plurality of linearly aligned buttonholes releasably coupleable to the buttons disposed on the strips of the base, whereby the restraining unit is adapted to secure about a portion of the shoe corresponding to an ankle of a user and further bind the base to the shoe; and a metal rod with a threaded end and a bolt end adapted to insert within a lateral bore formed in a heel of the shoe and further within the apertures of the tabs located on the strips, the rod further comprising a nut for coupling with the threaded end of the rod and firmly fastening the base to the shoe.

* * * * *